United States Patent [19]

Kohl et al.

[11] 4,131,006

[45] Dec. 26, 1978

[54] FIXED MECHANICAL FEED FOR A RIVETING DEVICE

[75] Inventors: Harry E. Kohl, Kettering, Ohio; Gordon Cotton, Chelsea, Mich.

[73] Assignee: The International Tool Company, Dayton, Ohio

[21] Appl. No.: 881,670

[22] Filed: Feb. 27, 1978

[51] Int. Cl.[2] ..... B21D 15/12; B21D 15/26

[52] U.S. Cl. ..... 72/67; 72/406

[58] Field of Search ..... 72/67, 122, 125, 126, 72/406, 429; 29/243.53, 243.54

[56] References Cited

U.S. PATENT DOCUMENTS

| | | | |
|---|---|---|---|
| 3,440,850 | 4/1969 | Friedrich | 72/67 |
| 3,653,243 | 4/1972 | Ramseier | 72/122 |
| 3,990,285 | 11/1976 | Dragoun | 72/67 |

FOREIGN PATENT DOCUMENTS

| | | | |
|---|---|---|---|
| 517514 | 12/1976 | U.S.S.R. | 72/406 |

*Primary Examiner*—C.W. Lanham
*Assistant Examiner*—Gene P. Crosby
*Attorney, Agent, or Firm*—Jerome P. Bloom

[57] ABSTRACT

Riveting apparatus is shown to comprise a riveting spindle mounted for vertical reciprocating movement in a frame under the influence of a cam controlled lever and a reacting spring means. A motor in driving relation to a rotary shaft embodied in the spindle operates a wobble type riveting tool. Depending on the embodiment the same or a separate motor functions to drive a cam device, through the medium of which the lever is uniformly and periodically cycled to produce a vertical movement of the spindle which carries the riveting tool to and from an underlying work piece. One end of the lever is connected with the spindle while the other is pivotally anchored to the projected extremity of the piston rod of an air cylinder. The latter may be set to fix the operative position of the projected extremity of the piston rod and thereby the pivot point of the lever. It serves also to accommodate the shock of an excess riveting load and to enable a simple, safe and sure adjustment of the pivot point of the lever as and when required.

21 Claims, 10 Drawing Figures

39
46
48
50
70
64
66
42
41
40
44
13
38
36
58
57
74
17
16
12
68
56
109
76
14
10
112
107
84
88
106
113
108
96
98
96
142
129
117
115
111
104
82
92
144
12
142
130
94
128
100
14
129
124
138
18
130
152
137
26
150
136
126
156
154
30
34
15
122
24
20
32
120
22

10
9
7
200
201
202
203
206
208
220
222
234
236
238
240
242
244
248
250
252
256
258
260
262
264
266
268
270
272
274
276
282
286
288
290
294
296
298
300
301
302
304
306
308
310
312
314
316
318
320
322
324

FIXED MECHANICAL FEED FOR A RIVETING DEVICE

BACKGROUND OF THE INVENTION

This invention relates to improvements in riveting and like machines and more particularly to apparatus providing a new approach to controlling a riveting operation. The invention embodiments afford relief from irregularities experienced in such procedures and produce a more uniform and more accurate riveting operation than is presently possible when using the available equipment of the prior art.

A most serious problem experienced in conventional riveting procedures is that which results from excess riveting load. This can cause fracture of a rivet or its improper application. The problem stems in part from the fact that rivets are not precision formed and may vary somewhat in size and configuration. If the riveting apparatus employed, as is often the case, cannot accommodate or compensate for such variations, the results are less than satisfactory. The use of the present invention overcomes this long standing problem. At the same time it enables a riveting machine which is simple to fabricate, more efficient and satisfactory in use, adaptable to a wide variety of applications and unlikely to malfunction.

SUMMARY OF THE INVENTION

An embodiment of the invention provides a riveting spindle the relatively rotating shaft of which mounts a wobble type riveting tool. The spindle is mounted for vertical reciprocating movement in a frame under the influence of a pivotally interconnected, cam controlled, lever and a reacting spring means. The end of the lever remote from the spindle has a pivotal connection to the piston rod of an associated air cylinder. By appropriate adjustment of this rod the pivot which forms its connection with the lever is relatively fixed as to its location. At the same time the air cylinder provides means enabling a simple, safe, sure, and automatic accommodation of excess riveting load applied to the lever and the riveting spindle as and when necessary.

In one embodiment illustrated the shaft in the spindle is driven by a motor which is also utilized to furnish a power source for operating the cam device through the medium of which the lever is pivoted in one sense while the reacting spring means serves to effect a movement of the lever in the opposite sense, in cyclic fashion. In a preferred embodiment the cam device is operated by a separate motor. In either case, the whole arrangement insures a precisely controlled vertical travel of the riveting spindle and the associated tool so that each stroke thereof is uniform and quite accurate as to its direction and location. At the same time, as indicated, the use of the air cylinder to provide a pivot type anchor for the operating lever, under the influence of the movement of which the spindle is reciprocated, inherently dictates that the piston rod of the air cylinder can self adjust or be adjusted to control the nature and degree of load applied to the lever and thereby to the spindle by the cam device. In any event, the use of an air cylinder as illustrated provides means accommodating shock and excess riveting load in the operation of the riveting apparatus, all to the advantage of achieving a better end product.

It is accordingly a primary object of the invention to provide riveting apparatus with improved control which is economical to manufacture, more efficient and satisfactory in use, adaptable to a wide variety of applications and unlikely to malfunction.

A further object of the invention is to provide riveting apparatus wherein the riveting spindle and the associated riveting tool are mounted for reciprocating movement in a frame under the influence of a cam controlled lever and an energy storing means.

Another object of the invention is to provide improved riveting apparatus embodying controls wherein the riveting spindle and the associated tool are mounted for vertical working movement under the influence of a lever controlled by a cam, which lever has a pivot position determined by shock accommodating means designed to yield to absorb reflected shock and stress.

An additional object of the invention is to provide riveting apparatus including a spindle the vertical movement of which is under the control of an interconnected lever the remote end of which has a pivot mount to the piston rod of an air cylinder which establishes a normally fixed position of the pivot about which the lever is caused to move, under the influence of a cam, to produce a vertical working movement of the spindle and an associated tool.

Another object of the invention is to provide riveting apparatus possessing the advantageous structural features, the inherent meritorious characteristics and the means and mode of use herein described.

Referring to the drawings wherein one but not necessarily the only form of embodiment of the invention is illustrated, FIG. 1 is a generally schematic, partly sectional, side elevation view of riveting apparatus embodying controls in accordance with the present invention, parts being eliminated for clarity of disclosure;

Like parts are indicated by similar characters of reference throughout the several views.

Figure 1:
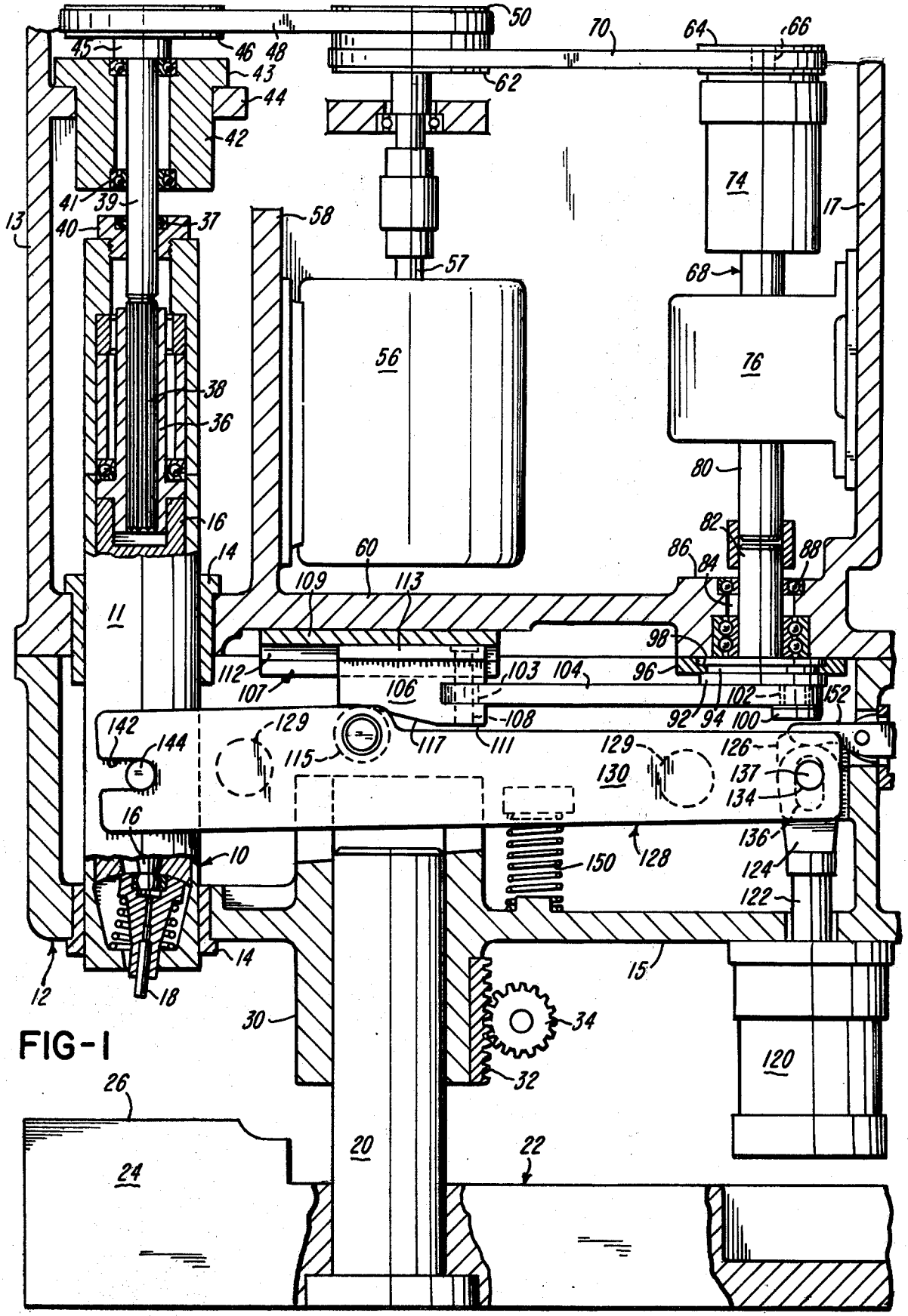
Figure 2:
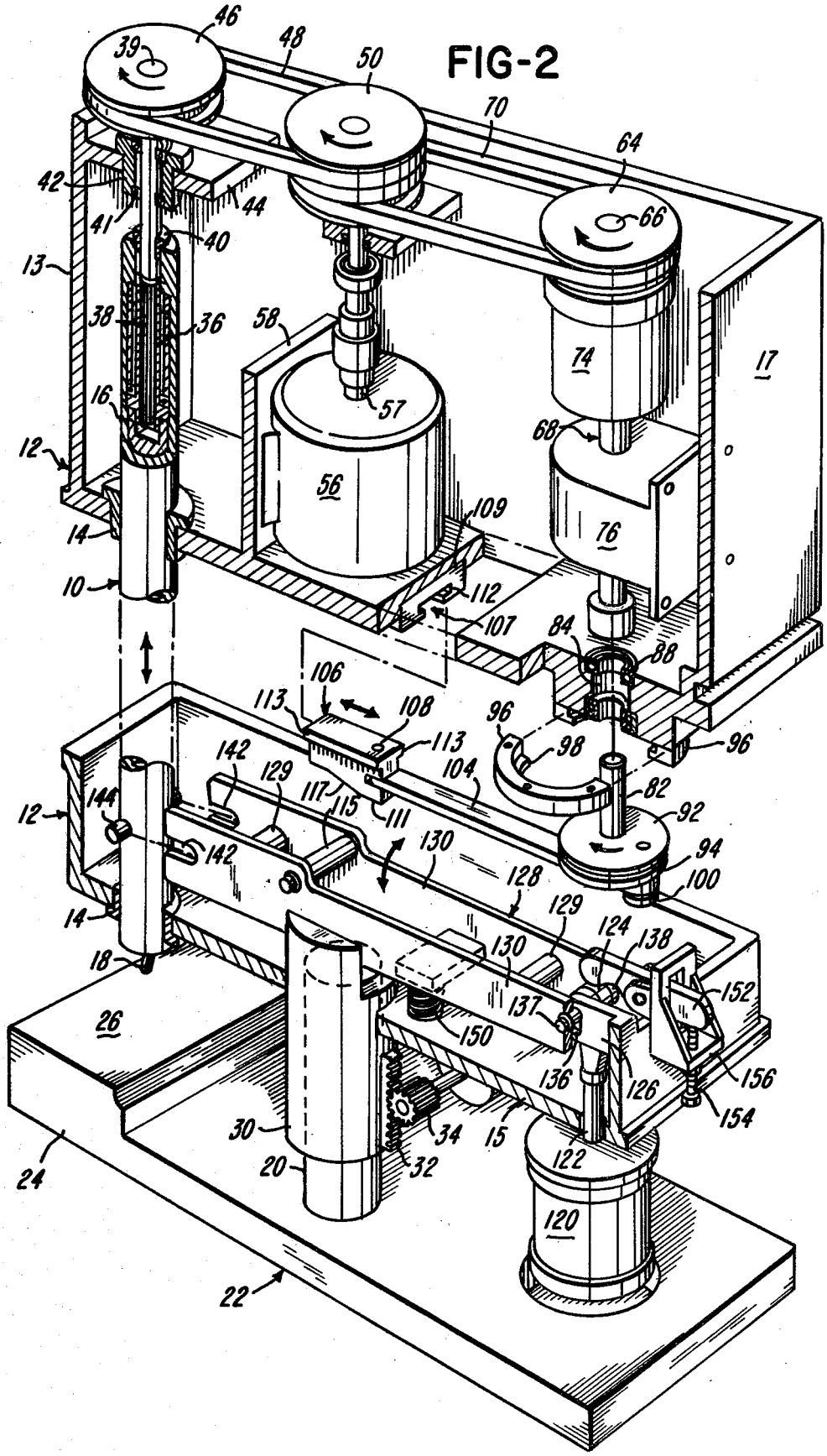
FIG. 2 is an exploded diagrammatic view illustrating the essential elements of the apparatus of FIG. 1.
Figure 3:
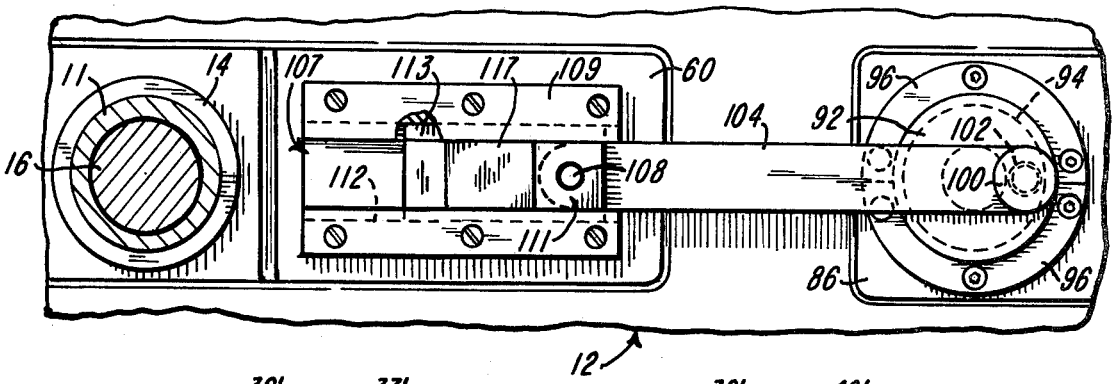
FIG. 3 is a view taken on line 3—3 of FIG. 1, parts being omitted for clarity of disclosure.

As seen in FIG. 1, the invention embodiment herein illustrated includes a spindle assembly 10 mounted for a vertical reciprocating movement in a frame 12 in which it is contained in and by aligned, vertically spaced, bearings 14. The bearings 14 are mounted in vertically spaced horizontally extending plate portions of the frame 12.

The spindle assembly 10 comprises a housing 11 containing and mounting for rotation therein a shaft 16 the lowermost end of which is adapted to receive and mount a wobble type riveting tool 18.

The frame 12 is mounted on the upper end portion of a post 20 which is fixed to project upwardly from and perpendicular to a base plate 22. The plate 22 incorporates a relatively elevated platform portion 24 presenting an anvil-type work surface 26 at what may be considered the front end thereof. The spindle assembly 10 is so mounted to have its central axis orient perpendicular to the surface 26 and it is normally positioned to provide that the operating end of the riveting tool 18, which projects through and from an opening in the lower end of housing 11, is located above and in vertically spaced relation to the surface 26.

The frame 12 may be mounted to the post 20 by any suitable means which may establish a fixed relation therebetween. In the showing of FIG. 1 of the drawings, the frame includes an opening in its bottom defined by an axially extended tubular boss 30 which receives and bears on and about the upper end of the post 20. In connection with the boss 30 is a rack 32. A pinion 34 drivingly related to the rack 32 is suitably powered to provide, in an obvious manner, for the boss 30 and the frame 12 to be adjusted in a sense vertically of the post, if and when required.

A tubular extension 36 coupled to the uppermost end of the shaft 16 receives therein, in splined engagement therewith, the lowermost end portion 38 of an axially aligned drive shaft 39. The shaft 39 extends through and upwardly of an upper cap portion 40 of the housing 11, a bearing seal 37 being provided therebetween. The splined connection between the drive shaft 39 and the tubular extension 36 of the shaft 16 is such to permit an axial adjustment of the extension 36 with reference to the drive shaft portion 38 and, correspondingly, an axial movement of the housing 11 and the included elements 18 and 36 with respect to the drive shaft 39. The purpose of this will be further described.

Suitable bearings set between the shaft 16 and the housing 11, the shaft extension 36 and the housing 11, and the shaft 39 and the housing 11, provide that the interconnected shaft elements form an assembly which may be driven for rotation in, relative to and independently of the housing 11.

Above the upper end of the housing 11, the drive shaft 39 projects through vertically spaced bearings 41 respectively nested in opposite ends of a sleeve 42. The sleeve 42 extends through an opening in a horizontal plate portion 44 of the frame 12 to which it is suitably fixed through the medium of an external flange 43 on the uppermost end thereof which overlies the plate portion 44. A collar 45 fixed about the drive shaft 39 immediately above the sleeve 42 and its uppermost bearing 41 has a radial extent which is such that it provides means for suspension of the drive shaft 39 in the frame 12. Upwardly of the collar 44 the projected extremity of the drive shaft 39 mounts in fixed relative thereto a pulley wheel 46.

It will be noted that the position of the collar 45 on the shaft 39 will determine the extent to which the drive shaft 39 depends below the lower extremity of the sleeve 42.

A horizontally oriented plate portion 60 of the frame 12 spaced below and parallel to the plate portion 44 has formed integral therewith and perpendicular thereto an upwardly projected plate segment 58. The spindle assembly 10 is positioned between and parallel to what may be considered the front wall 13 of the frame 12 and the plate segment 58. A motor 56 fixedly mounted to the surface of the plate segment 58 which is remote from the front wall 13 of the frame 12 is oriented to provide that its drive shaft 57 extends upwardly of the frame 12 parallel to the drive shaft 39. A pulley wheel 50 is fixed to the upper extremity of the drive shaft 57 to lie in a plane common to that of the pulley wheel 46. The pulley wheel 50 and the wheel 46 are interconnected by a loop formed continuous V belt 48.

Also fixed to and for rotation with the shaft 57, spaced between the housing of the motor 56 and the pulley wheel 50, is a pulley wheel 62. The wheel 62 is drivingly related to a pulley wheel 64 fixed to a segment 66 of a shaft assembly 68 through the medium of a continuous loop formed V-type drive belt 70. The shaft assembly 68 is arranged to be parallel to the shaft 57 and the segment 66 thereof is connected to the input shaft segment of a Horton air clutch 74. The output of the clutch 74 is connected to the input shaft segment of a reducer 76 mounted in fixed relation to what may be considered the back wall 17 of the frame 12. The output shaft portion 80 of the reducer 76 is coupled to a shaft segment 82 of the assembly 68 which projects through an aperture 84 in a horizontal plate portion 86 of the frame 12. The plate portion 86 is in a plane commonly occupied by the horizontal plate portion 60. The aperture 84 is counterbored at each of its ends to form recessed shoulders which seat bearings 88 in each of the upper and lower faces of the segment 86. The bearings 88 accommodate the shaft segment 82 for rotation therein and relative thereto. The lowermost end of the shaft segment 82 is enlarged by an integrally connected disc 92 the peripheral surface of which is formed with a circumferential groove 94. A split retainer device 96 secured to the under surface of the plate portion 86 forms a ring shaped wall which immediately contains the disc and embodies an annular flange 98 at the lowermost edge thereof which projects inwardly of the groove 94. The disc 92 is so confined to bear against the under surface of the plate segment 86 and to rotate within and relative to the device 96 as the motor 56 is energized to drive the shaft segment 82 through the medium of the intervening reducer 76.

The housing of an air cylinder 120 is end mounted to depend from and perpendicular to the bottom 15 of the frame 12, adjacent its back wall 17. The piston rod 122 of the air cylinder which is connected at one end to a head positioned interiorly of the cylinder housing, by fluid conventionally applied therein under pressure, projects through and from the upper end of the cylinder housing to the interior of the frame 12 by way of an aperture in its bottom 15. The upper projected extremity of the rod 122 mounts an adapter 124 which is arranged to position between and in spaced parallel relation to two vertically oriented transversely spaced plate-like projections 126 which extend from the back wall 17 of the frame 12.

A headed pin 100 thrust freely through an aperture 102 in one end of a plate-like, horizontally oriented lever 104 has the projected extremity thereof releasably engaged in the body of the disc portion 92 of the shaft segment 82. The said one end of the lever is thus bearingly confined between the head of the pin and the under surface of the disc. The pin 100 is located in a radially offset and parallel relation to the central axis of the shaft segment 82.

The end of the lever 104 remote from the aperture 102 has a similar aperture 103 the axis of which is parallel to that of the aperture 102 and vertically oriented. The end of the lever 104 including the aperture 103 is inserted in a notch formed in one end of a cam block 106, intermediate its vertical limits. Aligned apertures in the vertically spaced portions of the block 106 which define this notch have press fit therein a pin 108 which passes freely through the aperture 103 in the intermediately positioned end of the lever 104. This arrangement provides the lever 104 with a capability of pivoting about both the body of the pin 100 and the body of the pin 108 in the course of a horizontal reciprocation thereof under the influence of a rotation of the shaft segment 82.

The cam block 106 is nested for a horizontal sliding, reciprocating movement in the groove 107 formed in and extending longitudinally of the bottom surface of a guide block 109 fixed to depend from the under surface of the plate segment 60. The groove 107 is open to either end and the side walls thereof are provided with transversely aligned shallow grooves 112 which accommodate, for bearing movement therein and longitudinally thereof, generally rectangular plate-like extensions 113 formed on the outer side wall surfaces of the cam block 106. The block 106 has an under surface 111 which is contoured so it may function as a cam designed to meet the requirements of the particular application. In the case illustrated it is configured to have a slope 117 which inclines upwardly and forwardly from its lowermost limit, from a line adjacent and spaced forwardly of the apertures accommodating the pin 108, in the direction of the spindle assembly 10.

In the application of the block 106 the cam surface 117 bears for movement on and relative to a transversely disposed underlying needle bearing 115. The latter bridges and forms a connection between a pair of transversely spaced parallel plate-like arm members 130 which are further bridged, at locations spaced longitudinally thereof, by connector strips 129 which define therewith a lever-like arm unit 128.

The members 130 form the lateral side walls of the unit 128 which in the inoperative position thereof is substantially horizontally disposed. The arms 130 at one end of the unit 128 position outwardly of and in embracing relation to the pair of plate-like projections 126. Each of the arms 130 has an aperture 134 arranged to align with portions of vertical slots 136 formed in the projections 126. An aperture 125 in the adapter 124 receives therethrough a pivot pin 137 which extends laterally, to either side thereof, through a spacer 138, a slot 136 in a projection 126 and, finally, through an aperture 134 in an arm 130. As so applied the pin 137 is fixed with reference to the arms 128 and serves to pivotally connect said one end of the lever-like unit 128 to the adapter 124, the connected piston rod of which has the head thereof normally controlled as to its position by fluid under pressure. The vertical position of the aperture 125 in the adapter may be conventionally set utilizing the controls which are conventionally provided in connection with the air cylinder 120 of which it forms an operative part.

The ends of arm elements 130 remote from the pin 137 have identical notches formed inwardly of their projected extremities to form guide channels 142 the innermost or base portions of which are formed on a radius. This radius corresponds to that of needle bearings 144 which project outwardly from and radial to diametrically opposite points on the outer surface of the housing 11 of the spindle assembly 10. The bearings 144 project in and extend transversely of the channels 142, bearing on and for support longitudinally of the edge portions of the arm elements which define the channels in the course of the pivoting operation of the unit 128 as will be further described. Intermediate the pivot 137 and the bearings 144 the lever-like unit 128 passes through a channel shaped cut in the upper end of the boss 30, over and in vertically spaced relation to the upper end of the post 20. A compression spring assembly 150 positioned between the bottom 15 of the frame 12 and a bridging portion of the arm unit 128 spaced forwardly of the pivot 137 serves to apply a bias to normally maintain the inoperative normally generally horizontal position of the lever-like unit 128 and the engagement of bearing 115 with the cam surface 117.

Projected through a slot in the back wall 17 of the frame 12 and pivotally connected intermediate its ends to lug-like projections interiorly of the frame is a shoft lever-like element 152. The end of the lever 152 within the frame positions immediately over and provides an abutment surface against which the upper end of the adapter 124 limits in its set position. The outer end of the lever 152 is abutted by the upper extremity of a vertically oriented screw 154 threaded through a horizontal plate 156 fixed in connection with and projected outwardly from the back wall 17 of the frame 12. The screw 154 may be vertically adjusted and fixed as to its set position by suitable adjustment of a lock nut conventionally applied about the screw between its lowermost or head end and the undersurface of the plate 156. The screw 154 thus functions to set the lever 152 in correspondence with the setting of the pivot pin 137, which is governed by the fluid pressure applied to the head of piston rod 122 in the housing of the cylinder 120. The arrangement dictates not only the establishment of a set position for the pivot about which the lever-like unit 128 is intended to move in the operation thereof but provides a condition wherein any force directed through the unit 128 will be accommodated by the fluid pressure in the cylinder 120.

In the operation of the invention embodiment above described the apparatus is set into operation by an energizing of the motor 56 utilizing conventional means and in a conventional manner. As the motor 56 is energized it simultaneously drives, through the medium of its shaft 57, the drive shaft 39, which has a driving splined connection to the shaft 16 by way of the extension 36, and the disc 92. In this latter respect there is an appropriate reduction in the RPM transmitted to the disc 92 by means of the reducer 76. Thus, once the motor is energized, the wobble type riveting tool 18 in connection with the shaft 16 will be rotated at high speed as the disc 92 is rotated at a considerably slower speed to reciprocably drive the lever 104 and the connected cam block 106 through the medium of the eccentrically connected pin 100. As the cam block 106 is moved in the direction of the spindle assembly 11 its cam surface 117 gradually bears down on the bearing 115 and through the medium thereof produces a downward pivoting movement of the unit 128 about the pivot pin 137. Due to the sliding interconnection between the unit 128 and the housing 11 of the spindle assembly, provided by the bearings 144 in the channels 142, as the unit 128 is moved downwardly under the influence of the cam block, the spindle assembly and the shaft elements which form a part thereof are lowered to bring the riveting tool 18 into operative contact with materials to be riveted together which are located therebelow on the surface 26 of the base portion 24. The relative timing is such that the riveting tool will be established at the proper level and for sufficient period of time, at the lowermost level of travel of the spindle assembly 10, to achieve this desired function. In the retraction of the cam block 106 in the cyclic rotation of the pin 100 the pressure applied therethrough to the bearing 115 will be relieved, whereupon the spring 150 will automatically function to pivot the lever-like unit 128 upwardly and oppositely to restore it to a horizontal position. The pivoting of the lever-like unit 128 is in any case normally and positively achieved about the pin 137 the position of which is pre-set by the setting of the air cylinder 120 and the piston rod 122 which forms its operative part. This insures that the strokes of the spindle assembly, in a vertical sense will be precise and uniform in each course of its movement to the work materials which are placed below the connected riveting tool 18.

Should, for any reason, it appear that excess riveting load is being applied, an easy and ready adjustment of the position of the pivot pin 137 may be achieved by appropriately adjusting the setting of the piston rod 122. Should it unexpectedly occur that there is what could be an excess riveting load, and shock of a premature engagement of the tool 18 with the work material and subsequent pressure applied by an attempt to further lower the spindle assembly 10 under the influence of the cam block 106, the end of the level-like unit 128 including the pivot pin 137 will react against the upper portion of the adapter 124 and the limiting device 152 in a manner to produce a counter reaction accommodated and damped by the fluid under pressure in the cylinder 120. As may be seen, there is an automatic accommodation of shock which will not only prevent damage to the components of the apparatus but to the materials upon which the apparatus may work.

What the invention provides is the use of a fixed force air cylinder adjustable and self-adjustable for relief from excess riveting load. The arrangement is such that the pivot point for the unit 128 remains normally fixed but it is adapted to move down to provide relief from unusual load in the operation of the riveting apparatus.

As will be obvious the cam block 106 may be interchanged to provide a unique feed cam surface such as may be necessary to meet a particular application.

The unusual aspect of the invention apparatus and its application is that it provides accuracy and reliability of the riveting operation the degree of which is greatly improved over that possible using the prior art apparatus which employs a fixed pressure.

Apart from the principal benefit of the invention, the construction herein described offers simplicity of arrangement and function which makes the apparatus economical to fabricate and more efficient and satisfactory in use.

It is believed apparent and understood that in the reciprocating movement of the spindle assembly 10 the entire assembly will move through its course of travel and relative to the drive shaft 39 by reason of the sliding connection permitting the same, the sliding connection being afforded between the splined end portion 38 of the drive shaft 39 and the upper extension 36 of the shaft 16.

Figure 4:
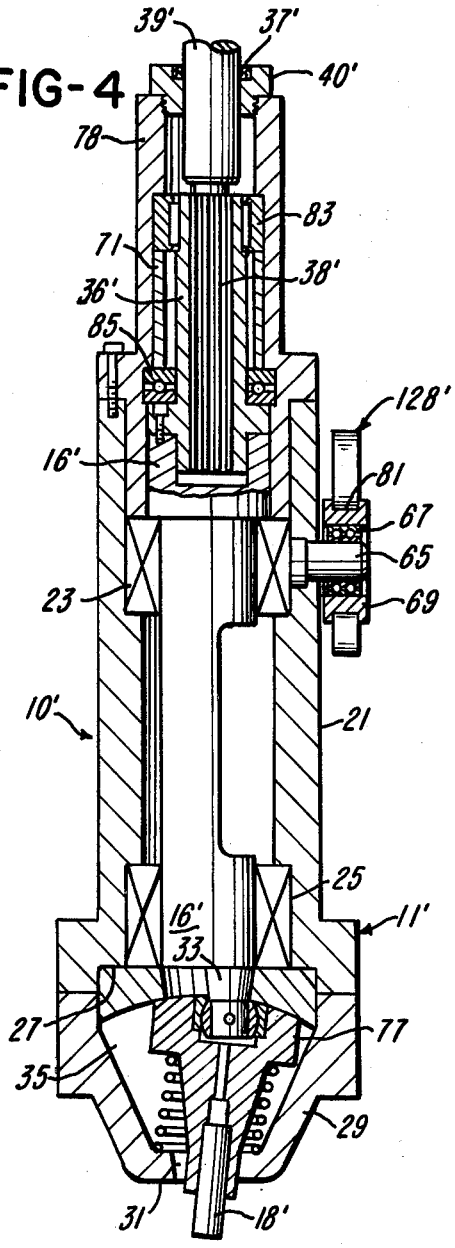
FIG. 4 is a generally schematic sectional view of a preferred embodiment of a spindle assembly which may be utilized in the apparatus of FIGS. 1 through 3.
Figure 5:
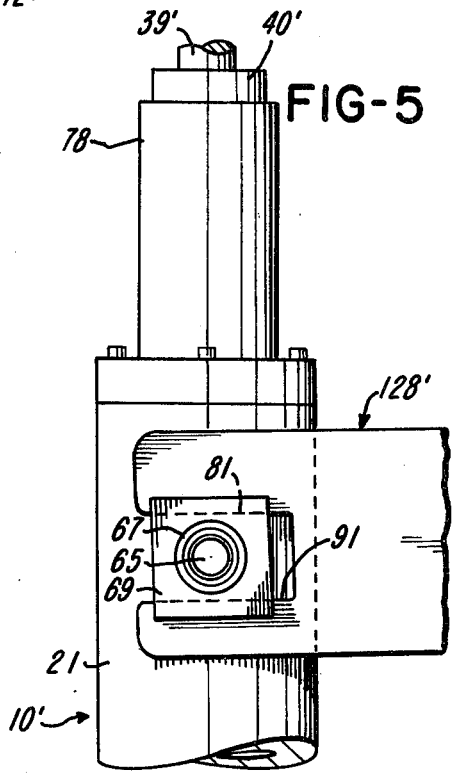
FIG. 5 is a fragmentary view illustrating details of the connection of the lever utilized to effect a vertical reciprocating movement of the spindle assembly shown in FIG. 4.

Particular note, however, is made of FIGS. 4 and 5 of the drawings which demonstrate a preferred embodiment of spindle assembly. The parts are generally similar to the spindle assembly 10 and the similar components thereof are identified by similar numerals utilizing prime symbols. In the showing in FIG. 4 it may be seen that the housing 11' of the spindle assembly 10' is comprised of a main tubular segment 21 open to each of its upper and lower ends which are respectively counterboard to provide oppositely facing shoulders which respectively seat a ring shaped bearing 23 in the one case and a ring shaped bearing 25 in the other. The counterbore at the lower end of the tube structure 21 is rimmed by a recessed shoulder 27 in its radially expanded lowermost extremity, the shoulder 27 being generally coplanar with the lowermost end of the bearing 25. The lower end of the tube structure 21 is provided with a closure element in the form of a cup-shaped cap 29 having a generally conically convergent opening 31 in its center. Slip fit in the tube structure 21 to be bearingly contained within the bearings 23 and 25 and to have a shoulder limiting against the upper end of the upper bearing 23 is a shaft element 16'. Projected from the lower end of the shaft element 16', in offset relation to its central axis, is an eccentrically positioned extension 33 which projects interiorly of the chamber 35 defined by the lower end of the tube structure 21 and the cap 29. Seated to the shoulder 27 and in rimming relation to the lower end of the shaft 16' is an annular bearing device the lower surface of which has an arcuately concave contour. Mounted in connection with the projection 33 of the shaft 16', within the chamber 35, through the medium of a universal joint, is a wobble type head 77 for the shaft which accommodates therein and to axially project therefrom a riveting tool 18'. As schematically illustrated, in the rotation of the shaft 16' there is an eccentric movement of the projection 33 and a wobbling movement of the connected head 77 which results in a special rotary action of the riveting tool capable of smoothly and effectively achieving a riveting function. The details of the riveting tool and its head are not further described since the same may be of a conventional nature. The upper end of the housing 11' as shown in FIG. 4, includes a tubular extension 78 of the tube structure 21 the internal diameter of which is successively reduced in dimension to form longitudinally spaced shoulders facing downwardly of the spindle assembly. Abutted against each of these shoulders and separated by a thin tubular spacer 71 are bearings 83 and 85. These bearings combine for rotation therein of a tubular extension 36' of the shaft 16'. As will be seen in the drawings, the extension 36' has an external flange adjacent and in spaced relation to the lower end portion thereof, which is rectangularly shaped and nests in a complementary female cavity in the upper end of the shaft 16'. The flange on the extension 36' is suitably connected to the upper end of the shaft 16', about the cavity therein, to establish a fixed connection therebetween. As seen in FIG. 4, the lowermost bearing 85 mounts between the lowermost shoulder on the extension 78 of the housing 11' and the flange on the extension 36'. The inner wall surface of the extension 36' has a series of circularly spaced longitudinally extending grooves accommodating a sliding, splined engagement therewith of a lowermost splined end portion 38' of a drive shaft 39' which corresponds to the drive shaft 39 in the first described embodiment of the invention. An annular cap device 40' forms a plug type closure for the upper end of the housing extension 78 and incorporates a bearing in a sealing and containing relation to the drive shaft 39' which projects therethrough. It is contemplated that the shaft 39' will be suspended and incorporated in connection with the frame 12 in a manner as first described.

In the case of the spindle assembly 10' the tube portion 21 of the housing 11' embodies in the side wall thereof, at a level intermediate the vertical limits of the bearing 23, a pin-like outwardly directed radial projection 65. A bearing 67 is mounted for rotation on and fixed against movement in a sense longitudinally of the projection 65. The bearing 67 is oriented in a vertical plane and fixed in an aperture in a rectangular plate structure 69 the upper and lower edges of which are each provided with a longitudinally extending groove 81.

In the case of the modification shown in FIGS. 4 and 5 it is contemplated that the lever-like arm unit 128 will be replaced by an arm unit comprised solely of a single plate-like arm element 128'. The arm element 128' will differ from the arm element 130 only in that the end thereof which pivotally connects to the spindle assembly will have a rectangularly shaped notch 91 providing that the upper and lower edge portions thereof will be slidingly mounted in the upper and lower grooves 81 in the plate 69 to accommodate relative movement therebetween. Since the bearing 67 provides for a pivoting movement of the plate 69 with respect to the pin 65, the pivotal connection between the lever-like arm unit 128' and the spindle assembly is essentially the same as in the case first described with the exception that the connection is at only one side of the spindle assembly. By the same token, the remote end of the element 128' will connect to the pivot pin 137 at only one end thereof.

As will be seen the association of the spindle assembly and the lever-like arm unit 128' with the remaining structure first described will be the same. The single arm element will incorporate a bearing means in a form and position such as the bearing 115 and the cam surface of the block 106 will similarly function under the influence of the connected structure.

In the case of the showing in FIGS. 4 and 5, once again the same is generally schematic and diagrammatic and is not detailed except to the extent necessary for one versed in the art to understand the normal arrangement and function of the illustrated components.

FIGS. 6–10 illustrate a preferred embodiment of the invention based in and on a frame 200. Fixed to one outer side surface 201 of the frame, intermediate its vertical limits, are a pair of guide bars 202 so formed and applied to provide facing, laterally spaced and vertically oriented grooves accommodating the laterally projected extremities of a plate 204. The plate 204 is fixed to and transversely of a tubular housing 206 of a spindle assembly 208 which provides a vertically oriented passage accommodating the projection therethrough of a shaft 210. A pair of bearing units 212, respectively positioned in contained relation to the upper and lower ends of the passage through the housing 206, are held in spaced relation by a tube 214 which extends between their inner races and together therewith provides for a bearing rotation of the shaft 210 in and with respect to the housing 206.

Figure 10:
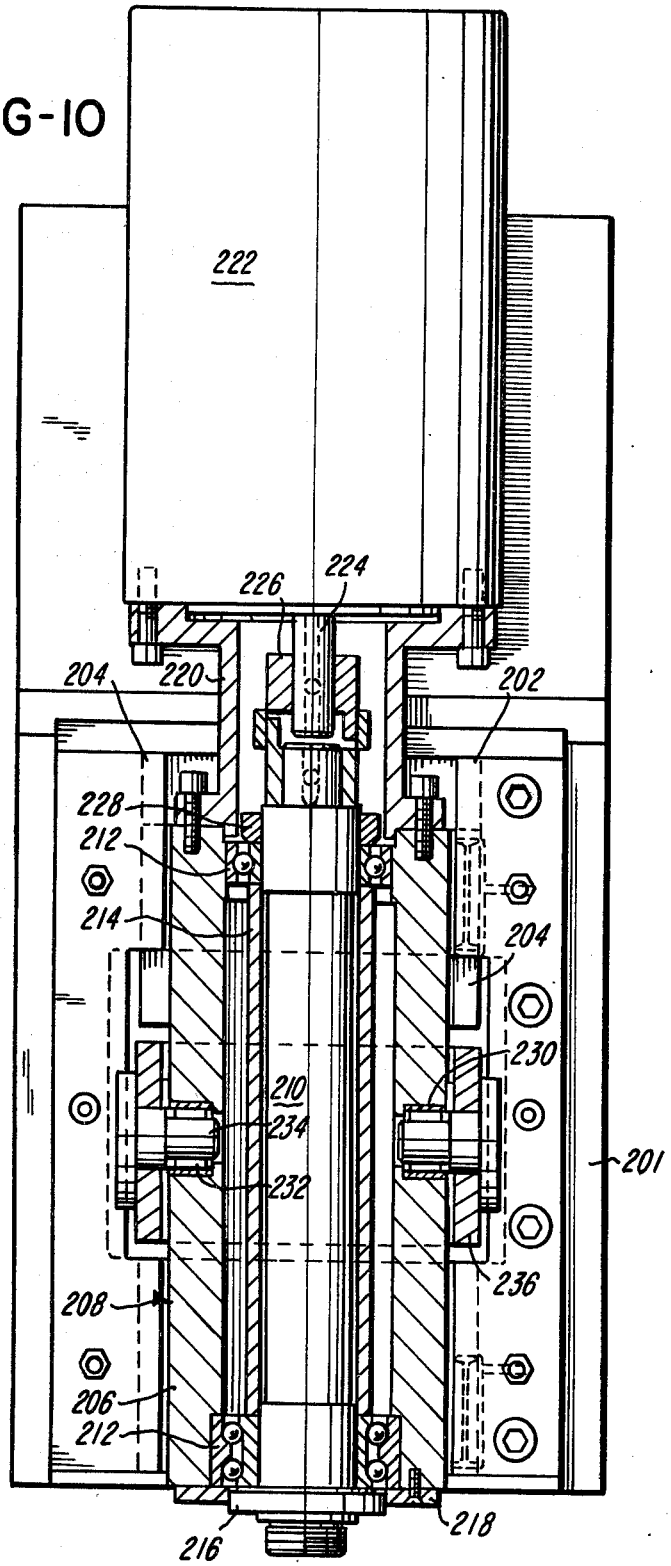
FIG. 10 is a sectional view on line 10—10 of FIG. 6.

Movement of the shaft 210 in a sense upwardly of its housing is limited by its external flange 216 which is abutted to the outermost surface of the inner race of the lowermost bearing unit 212. The flange 216, as seen in FIG. 10, nests within an annular plate 218 fixed over the lower end of the housing 206 to retain therein the outer race of the lowermost bearing unit 212.

A tubular adapter 220 fixed to form an axial and upwardly directed extension of the housing 206 has a large external flange on its upper end which seats, in fixed relation thereto a drive motor 222. The drive shaft 224 of the motor 222 projects downwardly and interiorly of the adapter 220, within which it is coupled to and axially extended by a tubular connector device 226 the lowermost end of which is telescoped over and fixed to the reduced diameter upper end portion of the shaft 210.

Immediately of its upper reduced end portion the shaft 210 is threadedly engaged by a nut 228 which serves to clamp against the innermost race of the uppermost bearing unit 212 and at the same time to cause flange 216 to clamp against the inner race of the lower bearing unit 212.

The coupling of a tool such as 18 or 18' for drive by the shaft 210 is neither shown nor described with reference to the embodiment of FIGS. 6–10 since the same may be achieved in various manner well known to those versed in the art, and in any event with the benefit of the showing in this respect in the embodiments of FIGS. 1 and 4.

The outer wall surface of the housing 206 is formed with a recess defining a socket 230 at each of two directly opposite, remote, locations. These sockets which are adjacent and spaced below the guide bars 202 are each lined by a bearing 232. Each bearing 232 accommodates for rotation therein, and relative to the housing 206, a pivot pin 234 projected from and perpendicular to one end of a narrow, elongate, generally rectangularly configured bar 236. The bars 236, which are thus provided to have said one ends thereof embrace and pivotally connect to the housing 206, extend inwardly therefrom, through a passage in the frame 200 to a location adjacent the side 203 of the frame which is remote from its side 201, where they embrace an axial extension 238 of the piston rod 240 of an air cylinder 242.

The frame 200 embodies a series of weldments including vertically spaced horizontally extending plate portions adjacent and in connection with its side 203. An upper one 244 of these horizontal plate portions serves as a base to which the uppermost end of the air cylinder 242 is anchored. The cylinder 242 is so fixed as to have its piston rod 240, which connects to and projects perpendicular to the piston head (not shown) conventionally provided in its interior, depend vertically from and through the cap at its lower end. A tubular adapter 248 at the lower end of the cylinder, through which the rod projects, abuts a next lower horizontal plate portion 250 provided by another weldment as the rod 240 projects through an aperture therein and then connects to its extension 238 by threadedly engaging in a threaded bore in its upper end.

The end portions of the bars 236 which embrace the piston rod extension 238 extend to either end of an aperture 251 extending through and diametrally of the extension to present apertures therein in alignment therewith and with each other. These aligned apertures receive therethrough a pin 252 the ends of which are press fit in the bars and the intermediate portion of which is accommodated for rotative movement in the body of the rod extension 238. The aperture 251 is elongated somewhat, in a horizontal sense, to not only permit relative pivotal movement of pin 252 but a degree of horizontal movement, to facilitate thereby the required movement of the lever assembly 254 of which the bars 236 and the pin 252 form a part.

The lowermost end of the rod extension 238 projects through an aperture in a further weldment 256 and within the cup defined by the legs of a U-shaped bracket 258 fixed to depend from the bottom of the frame. Projected upwardly through an aperture in the center of the dependent base portion of the bracket 258 is a shaft-like element 260 contained for rotation therein and relative thereto and against axial movement. The upper extremity of the element 260 is externally threaded and threadedly engaged in a tapped recess in the center of the lower end of the rod extension 238. Connected to the lowermost end of the element 260, below the bracket 258, is a disc-like head 262 having equidistantly spaced indicia on its peripheral edge. Referenced to such indicia is a pointer 264 fixed to depend from one side of the bracket 258. The arrangement enables a micrometer type vertical adjustment of the rod extension 238 and thereby of the pivot pin 252, the amount of which can be predetermined by movement of the indicia relative the pointer. Thus, on a selective rotation of the disc 262 the shaft element 260 will turn in place and produce a corresponding vertical adjustment of the piston rod and its extension, placing the pivot 252 in a relatively fixed point of reference.

The lever assembly 254 includes a number of bars and plates positioned in a parallel relation, spaced longitudinally of and connected in bridging relation to the bars 236. One such plate 266 bridges the lower edges of the bars 236 adjacent their midpoint but spaced somewhat in the direction of the pivot 252. Releasably attached to the undersurface of the plate 266 and depending perpendicular thereto is a spring assembly 268. The latter depends through an aperture in a horizontal bottom plate portion of the frame 200 and within the central bore of a tubular guide 270 fixed to depend from the bottom of the frame. The spring assembly 268 is based against the upper end of a vertically adjustable bolt 272 which is suitably supported for a vertical adjustment with reference to the frame. Full details in this respect are neither shown nor specifically described since the manner in which such details may be incorporated may vary and are well within the skill of a mechanic. The position and character of the spring assembly 268 will determine the bias on the underside of the lever assembly 254 and thereby the normal inoperative generally horizontal position of the lever assembly.

Spaced forwardly of that point of the lever assembly to which the spring assembly 268 is applied, in the direction of the spindle assembly 208 but within the frame 200, the bars 236 are transversely bridged, adjacent their upper edges by a fixed pin 274 mounting a sleeve 276 between the adjacent sides of the bars. At its midpoint the sleeve 276 has a circumferential groove 278 the base of which is surrounded by bearing 280 rotatably mounting thereon an annular plate 282. The radially innermost portion of the plate 282 nests in the groove 278 and the radially outermost portion thereof projects outwardly therefrom and above the upper edges of the bars 236.

Figures 6, 7:
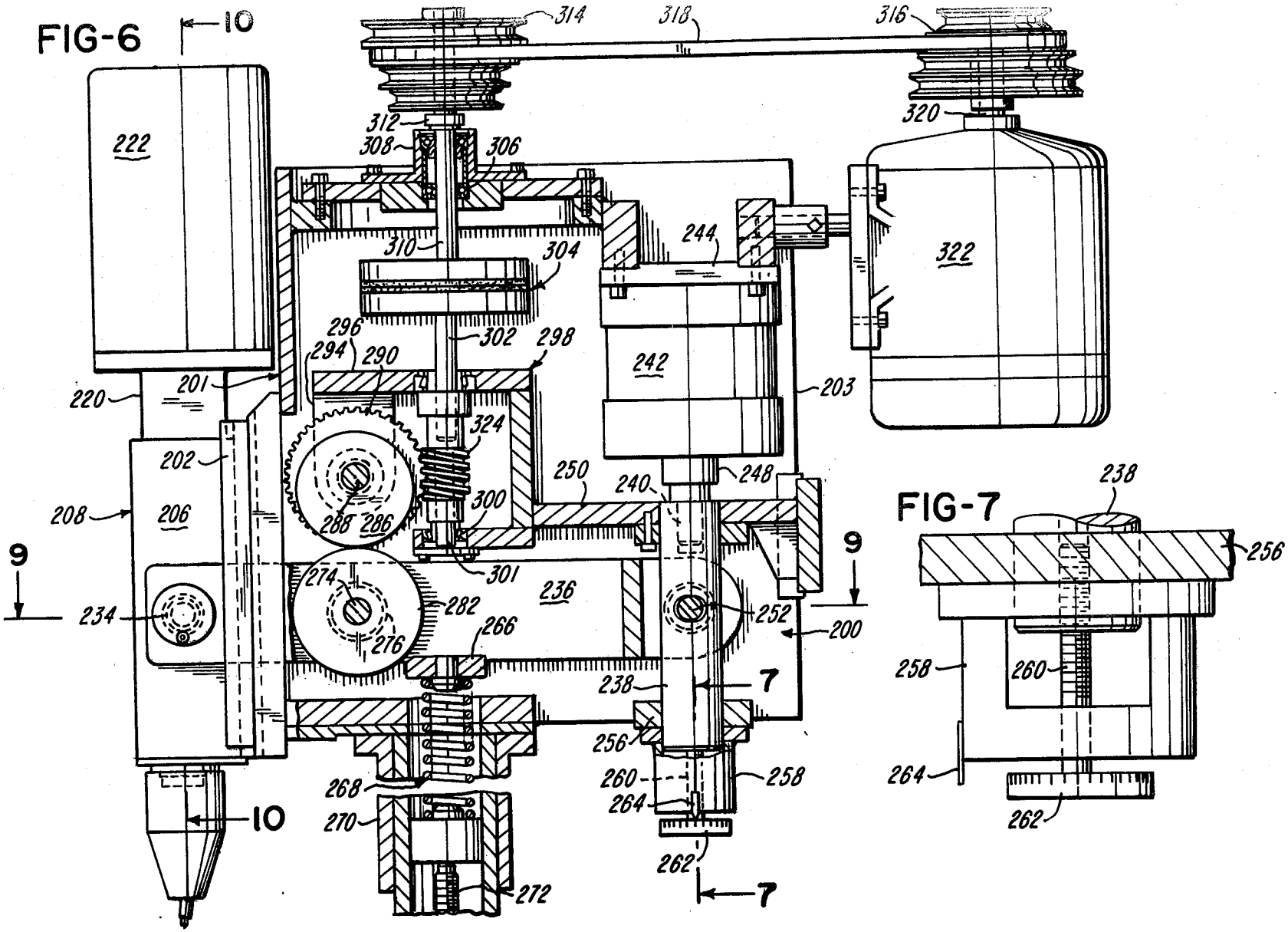
FIG. 6 is a front elevation view of a preferred embodiment of the invention, illustrated in generally diagrammatic or schematic fashion and only to the extent necessary for its understanding.
FIG. 7 is a fragmentary view taken on line 7—7 of FIG. 6.
Figure 8:
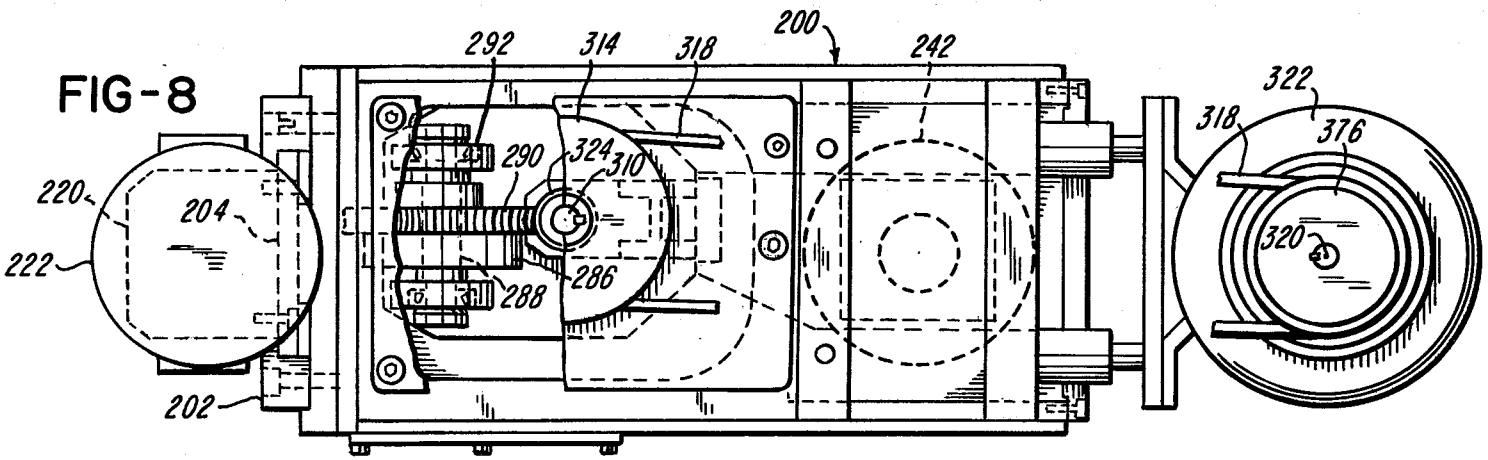
FIG. 8 is a top view of FIG. 6, parts being eliminated for clarity of disclosure.
Figure 9:
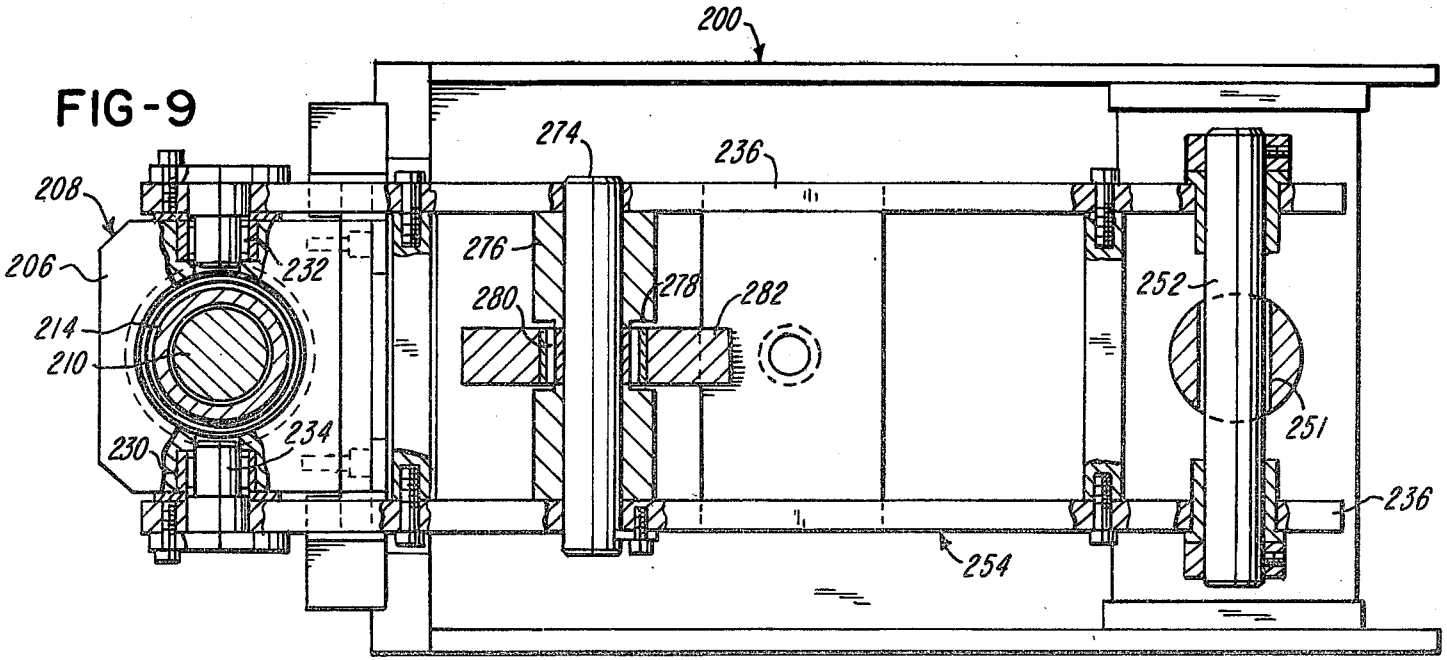
FIG. 9 is a sectional view on line 9—9 of FIG. 6.

The outer peripheral edge surface of a disc 286 bears on the outer relatively upwardly projected outer peripheral surface portion of the plate 282. The disc 286 is mounted eccentrically of a horizontal shaft 288 and bolted to one face of gear 290. Both the gear 290 and the disc 286 are fixed for rotation with the shaft 288 and contained thereon against endwise movement. The shaft 288 is supported for rotation in bearings 292 which are supported in turn by strap like dependencies 294 from a horizontal plate portion 296 of the frame constituting a portion of a further weldment 298. A portion of this weldment 298 includes vertically spaced horizontal plate portions, a lowermost of which seats, in the upper surface thereof a bearing 300 nesting the lower end of a shaft portion 301 forming an extension of a shaft portion 302 the upper end of which is coupled to the output side of a magnetic clutch 304 which is schematically illustrated in FIG. 6. Extending upwardly from the input side of the clutch 304 and through an aperture in the top of the frame 200 and bearings 306 held by a retainer 308 to line this aperture is a further shaft portion 310. A collar 312 fixed about the shaft portion 310 above the retainer 308 seats on the latter to properly position the shaft.

A pulley set 314 fixed about the upper end of the shaft portion 310 is driven from a complementary pulley set 316 by a V-belt 318. The pulley seat 316 is fixed on the upwardly projected end of the drive shaft 320 of a second drive motor 322. The latter motor is fixed at the top and to the outer surface of the side 203 of the frame 200.

The magnetic clutch 304 is a conventional unit interposed in and forming part of a drive shaft assembly additionally comprised of the shaft portions 301, 302 and 310. Fixed about the shaft portion 301 and contained thereon against endwise movement is a worm gear 324 which is geared and drivingly engaged to the gear 290. As will be obvious, on energization thereof the motor 322 will drive the gear 290 by way of its drive of the worm gear 324 and correspondingly rotate the eccentrically mounted disc 286. The latter will then serve as a cam, as it rides on and during a cycle thereof rotates and drives the annular plate 282 first downwardly and then relieves this plate to permit the return of the lever assembly 254 of which it forms a part to its normal horizontal position, under the influence of the spring bias of the assembly 268 in which energy is stored as the cam drives the lever assembly 254 downwardly about its pivot pin 252 the position of which is pneumatically held by the air cylinder 242. As the lever assembly 254 is pivoted downwardly, the pivotal interengagement of its pins 234 in the sockets 230 in the spindle housing 206 carries the housing and the contained drive shaft 210, the latter of which will then be rotatively driven by energizing the motor 222, downwardly, until the connected working tool such as 18 or 18' will be brought properly to bear on an underlying rivet to smoothly and quickly apply the same to the underlying workpieces. The application of the tool in accordance with the use of the invention will be firm and free of bounce, chatter and deflection. The cyclic action is simple but positive in nature and each stroke uniform in its application to a rivet. If the nature or character of the workpiece indicates an irregularity and improper back pressure should occur, the shock and/or stress normally resulting will be immediately dissipated through the lever assembly to and through the piston rod of the air cylinder and its extension. There is a smooth functioning damping effect. The result is an avoidance of malfunction and breakage or damage to parts. The air cylinder will similarly function should there be any obstruction to free and proper movement of the spindle. The feature of adjustability as to the pivot or fulcrum point of the lever assembly makes the invention apparatus flexible and adaptable to a variety of applications where the rivets and/or the parts to which they are applied may vary in size. Note the smoothness of the cam system in the embodiment just described as well as the fact wear and malfunction potential is absolutely minimized. There is also a smoothness added by the guided construction here provided for the housing 206.

It is emphasized that the invention is demonstrated in a generally schematic fashion and there has been no detailed showing or description of those parts required for embodiment of the invention which should be obvious to those versed in the art.

From the above description it will be apparent that there is thus provided a device of the character described possessing the particular features of advantage before enumerated as desirable, but which obviously is susceptible of modification in its form, proportions, detail construction and arrangement of parts without departing from the principle involved or sacrificing any of its advantages.

While in order to comply with the statute the invention has been described in language more or less specific as to structural features, it is to be understood that the invention is not limited to the specific features shown, but that the means and construction herein disclosed comprise but one of several modes of putting the invention into effect and the invention is therefore claimed in any of its forms or modifications within the legitimate and valid scope of the appended claims.

The embodiments of the invention in which an exclusive property or privilege is claimed are defined as follows:

1. Riveting apparatus comprising a generally vertically oriented spindle assembly including a drive shaft and a housing for said shaft mounting for movement to and from a work surface, said shaft being rotatable in and independently of said housing and the leading end thereof being adapted to mount a riveting tool which in the movement of said housing towards the work surface is applied to fix a rivet, a lever-like unit one end of which is operatively connected to said housing and the opposite end of which is pivotally connected to a control member to establish the position of the pivot thereof, and means operatively related to said lever-like unit to produce a movement of said lever-like unit about said pivot to cyclically and uniformly advance and retract said housing and said shaft with reference to said work surface.

2. Riveting apparatus as in claim 1 wherein the connection of said one end of said lever-like unit is constructed and arranged to provide for a relative movement between said housing and said lever-like unit.

3. Riveting apparatus as in claim 1 wherein said control member for said pivot is arranged to normally establish a fixed position of said pivot and a mount for said control member adapts it to yield to accommodate shock and stress reflected through said shaft and said lever-like unit in the operation thereof.

4. Riveting apparatus as in claim 1 wherein the positions of said control member and said pivot are maintained by means applying thereto fluid under a predetermined pressure.

5. Riveting apparatus as in claim 1 wherein means are applied to normally maintain the established position of said pivot and said position maintaining means includes means for adjustment of said pivot position, both automatically and manually as needs require.

6. Riveting apparatus as in claim 1 wherein said spindle assembly is mounted for a sliding vertical movement in connection with a frame which serves to house said lever-like unit and the means to produce a cyclic movement thereof and wherein the function of the latter and the stroke of said shaft is controlled by an air cylinder operatively connected to said control member.

7. Riveting apparatus as in claim 1 wherein said means to produce a cyclic movement of said lever-like unit includes means to limit the extent of said movement.

8. Riveting apparatus as in claim 7 wherein said means to produce a cyclic movement of said lever-like unit includes a cam device and a reactant biasing means.

9. Riveting apparatus as in claim 7 wherein said means to limit the extent of said cyclic movement of said lever-like unit includes automatically functioning spring retracting means.

10. Riveting apparatus as in claim 7 wherein said means to limit the extent of the movement of said lever-like unit includes a rotatable cam device which bears on a portion of said lever-like unit, the configuration of which cam device predetermines the extent of movement of said shaft and its housing towards the work surface in a manner to provide a uniform application of the applied work tool to each rivet.

11. Riveting apparatus as in claim 10 wherein said portion of said lever-like unit on which said cam bears is a rotatable portion of said lever-like unit.

12. Riveting apparatus as in claim 1 wherein said means to produce a cyclic movement of said lever-like unit includes a cam means mounted for a reciprocating movement on and in bearing relation to a portion of said lever-like unit, in a straight line path, so arranged to pivot said lever-like unit and move the connected shaft to carry an applied tool to the related work surface.

13. Riveting apparatus as in claim 12 wherein reactant spring means is applied to control the pivoting of said lever-like unit and so constructed and arranged to provide a reactant force to produce a retraction of said lever-like unit subsequent to each riveting operation.

14. Riveting apparatus as in claim 1 wherein said means to produce a cyclic movement of said lever-like unit is a cam means having an eccentric connection to drive means.

15. Riveting apparatus as in claim 14 wherein said shaft has a second drive means which is independent of the drive means for said cam means.

16. Riveting apparatus as in claim 1 wherein said shaft has superposed drive means and is mounted for an axial movement with respect to said drive means to accommodate movement of said housing to and from a work surface.

17. Riveting apparatus as in claim 16 wherein said drive means is commonly connected to operate said means to produce a cyclic movement of said lever-like unit.

18. Riveting apparatus as in claim 1 wherein said lever-like unit extends in a sense laterally of and projects to one side of said spindle assembly and embodies a roller means and said means for producing a cyclic movement of said lever-like unit includes a cam element supported for movement in a sense longitudinally of said lever-like unit to contact said roller means to produce a vertical motion of said spindle assembly in the direction of the work surface, the configuration of said cam means providing that in the movement thereof it varies its pressure on said roller means.

19. Apparatus as in claim 18 wherein energy storing means are provided in connection with said lever-like unit arranged to store energy as said spindle assembly is moved in the direction of the work surface, said energy storing means being operative at the lowermost limit of the motion of said spindle assembly to induce a pivoting motion of said lever unit resulting in movement of said spindle assembly to its uppermost position, in the process of which said cam means moves in a sense to relieve the pressure applied thereby to said roller means.

20. Riveting apparatus as in claim 1 wherein said lever-like unit includes a plate-like arm notched at said one end thereof to receive therein a radial projection from said housing and pivotally connected adjacent the other end thereof by a pivot pin constituting said pivot the position of which is set through said control member which is biased to a fixed position under the influence of fluid under pressure.

21. Riveting apparatus as in claim 20 wherein said pivot pin is connected to the projected extremity of a piston rod constituting said control member the head of which rod is contained in a cylinder and subjected to fluid under pressure to establish its position, and said pivot pin extends through a vertically elongated slot in means integrally connected with relatively fixed supporting means and an aperture in said opposite end of said arm element and there being means limiting the uppermost position of said pivot pin in connection with said piston rod in an arrangement providing that said pivot will move downwardly from said limit means for relief from unusual load in the operation of said riveting apparatus.

* * * * *

UNITED STATES PATENT AND TRADEMARK OFFICE

CERTIFICATE OF CORRECTION

PATENT NO. : 4,131,006

DATED : December 26, 1978

INVENTOR(S) : Harry E. Kohl and Gordon Cotton

It is certified that error appears in the above-identified patent and that said Letters Patent are hereby corrected as shown below:

Col. 3, line 57, "relative" is corrected to read -- relation --.

Col. 6, line 18, "shoft" is corrected to read -- short --.

Col. 7, line 15, "strokes" is corrected to read -- stroke --;

line 28, "level" is corrected to read -- lever --.

Col. 8, line 5, "board" is corrected to read -- bored --.

Col. 12, line 18, "seat" is corrected to read -- set --.

Signed and Sealed this

*First* Day of *May 1979*

[SEAL]

*Attest:*

RUTH C. MASON
*Attesting Officer*

DONALD W. BANNER
*Commissioner of Patents and Trademarks*